US005941297A

United States Patent [19]

Young

[11] Patent Number: 5,941,297

[45] Date of Patent: Aug. 24, 1999

[54] MANUFACTURE OF COMPOSITE MATERIALS

[75] Inventor: Robin Michael Kurt Young, Wantage, United Kingdom

[73] Assignee: AEA Technology PLC, Didcot, United Kingdom

[21] Appl. No.: 08/716,745

[22] Filed: Sep. 23, 1996

[51] Int. Cl.[6] ..... B22D 18/00; B22D 19/14

[52] U.S. Cl. ..... 164/62; 164/61; 164/97; 164/105; 164/120; 164/129

[58] Field of Search ..... 164/61, 63, 65, 164/62, 80, 97, 105, 120, 112, 129

[56] References Cited

U.S. PATENT DOCUMENTS

| | | | |
|---|---|---|---|
| 3,940,136 | 2/1976 | Cannell et al. | 164/112 X |
| 5,165,463 | 11/1992 | Aghajanian et al. | 164/97 |
| 5,322,109 | 6/1994 | Cornie | 164/97 |

FOREIGN PATENT DOCUMENTS

| | | | |
|---|---|---|---|
| 0332430 | 9/1989 | European Pat. Off. . | |
| 0728849 | 8/1996 | European Pat. Off. . | |
| 4303434 | 8/1994 | Germany . | |
| 61-48541 | 3/1986 | Japan . | |
| 63-199839 | 8/1988 | Japan . | |
| 1-289561 | 11/1989 | Japan . | |
| 3-146254 | 6/1991 | Japan | 164/112 |
| 2219537 | 12/1989 | United Kingdom . | |
| 2249636 | 3/1992 | United Kingdom . | |
| 2275008 | 8/1994 | United Kingdom . | |
| 2287038 | 9/1995 | United Kingdom . | |
| 2287205 | 9/1995 | United Kingdom . | |
| WO 94/02654 | 2/1994 | WIPO . | |

*Primary Examiner*—J. Reed Batten, Jr.
*Attorney, Agent, or Firm*—William H. Holt

[57] ABSTRACT

Metal matrix composite is made by assembling pre-forms of porous reinforcing material with an array of separator plates in a die in a pressure vessel, and infiltrating molten metal matrix material. Pre-evacuation followed by pressurisation when the molten metal matrix material is introduced into the die aids the infiltration. Re-introduction of gas during initial heating prior to melting speeds the heat-up process.

24 Claims, 3 Drawing Sheets

MANUFACTURE OF COMPOSITE MATERIALS

The invention relates to the manufacture of composite materials and more specifically to a method for manufacturing such materials in which a porous pre-form is impregnated with a matrix material by an infiltration process.

Patent specification GB 2 247 636 describes a number of processes which have been used in the manufacture of metal matrix composite materials and identifies disadvantages in methods which involve the use of massive die blocks to withstand the pressure applied for forcing molten metal to infiltrate the pre-form GB 2 247 636 described a method in which matrix material and a die containing a porous pre-form of reinforcing material are placed within a pressure vessel. The pressure vessel is evacuated whilst both the matrix material and the die are heated to a temperature above the melting point of the matrix material. The molten matrix material is then transferred into the die and the pressure vessel pressurised so as to cause the molten matrix material to infiltrate the pre-form.

I have now made a number of developments which extend and improve upon the aforesaid method.

According to the present invention in one aspect there is provided a method of manufacturing a composite material by infiltrating a molten matrix material into porous pre-forms of a reinforcing material, including the operations of locating within a die a plurality of separator elements of shape such as to define a plurality of cavities defining final product dimensions, and filling the cavities with porous reinforcing material comprising particulate material in which the particle size distribution is selected and controlled such that the majority of the particles have a size at or close to one of two different sizes, the relative proportions of particles at the respective two sizes being predetermined, placing the die within a pressure vessel together with a quantity of the matrix material, evacuating the pressure vessel, heating both the matrix material and the die to a temperature above the melting point of the matrix material which is positioned so that it is or can be brought into contact with the said porous reinforcing material, pressurising the pressure vessel so as to cause the molten matrix material to infiltrate the porous reinforcing material within the die, and cooling the die to cause the matrix material to solidify.

Conveniently, the matrix material is initially contained in a crucible also positioned within the pressure vessel, the crucible, the die and the contents of the die are heated together to a temperature above the melting point of the matrix material and the matrix material when molten is transferred from the crucible to the die.

Preferably the matrix material is initially contained within the die together with but separate from the porous reinforcing material, whereby, on heating the die, both the porous reinforcing material and the matrix material are heated to a temperature above the melting point of the matrix material, which infiltrates the porous reinforcing material.

In one arrangement according to the invention, the separator elements are in the form of thin plates defining therebetween a plurality of disc-shaped cavities filled with the said porous reinforcing material.

In another arrangement according to the invention, the separator elements are arranged in pairs with one element of each pair containing cavities filled with said porous reinforcement material and defining the desired shape of all but one side of the product to be formed upon infiltration of the porous reinforcing material with matrix material, and the second element of each said pair comprising a thin plate positioned adjacent the said one element to define the said one side of the product to be formed.

The separator elements may comprise graphite, ceramic (e.g. alumina) or metal, provided the metal is such as will withstand the temperatures to which the die is subjected. I have found that thin separator plates, particularly of stainless steel, serve well to enhance feed of molten aluminium into the inner regions of the cavities containing reinforcing material. The separator elements must be such as to withstand exposure to the liquid matrix material. Resistance of the separator elements to liquid metals can be enhanced by applying coatings. Preferably such coatings have mould release properties, as for example are provided by boron nitride or oxide layers.

I have also found that it is possible to construct the die, for use in this form of apparatus, from a metal such as stainless steel with very thin walls. The die can then readily be peeled away from the contents after the infiltration and cooling to solidify the matrix has been completed. It is preferred where practicable to use mild steel rather than stainless steel because of its lower cost and higher thermal conductivity.

By introducing an atmosphere (which may be at atmospheric pressure) of nitrogen or other gases not containing hydrogen into the pressure vessel, the thermal diffusivity of the pre-forms is increased with a consequent reduction in heating times. Heating may be carried out using resistance elements. However, it is preferred to use radio-frequency heating. This is particularly advantageous in that radio-frequency can bypass thermal insulation, so that the die can be provided with selective thermal insulation around the walls to promote directional solidification of the matrix material during the cooling step. A further advantage of radio-frequency heating is that the isothermal condition can be maintained controllably during infiltration. It is also possible to pre-heat the pre-forms outside the pressure vessel and then transfer them into the pressure vessel.

If the separator elements are of metal and a suitable frequency of radio-frequency heating employed, the separator elements will serve to enhance transfer of heat into the centre of the pre-forms so that heating times can be reduced. Preferably the separator elements have a higher thermal diffusivity than the pre-forms which will result in a faster heat up of the core, i.e. the inner contents of the die. The separator elements in the form of thin plates of relatively high thermal conductivity are advantageously provided with flanged portions at their edges to provide enhanced heat transfer paths from the die wall to the next adjacent separator plate.

As an alternative microwave heating can be used in which case, the presence of metals in the die and its contents would have to be avoided and the microwave heating could not, of course, be applied to the melting of metal matrix material or any continued heating during the infiltration. Enhanced internal heating using microwaves, could, however, be achieved using separator plates of an appropriate ceramic such as zirconia or zirconia-coated ceramic.

In accordance with preferred features of the invention, particle size distribution is controlled to provide that (a) the volume fraction in the product of the reinforcing material meets the required specification, in particular for matching a specified coefficient of thermal expansion (b) the capillary size of interstices between the particles within the pre-form is such as to permit infiltration at moderate pressures and times (c) the minimum particle size is larger than Kapitze radius (d) the maximum particle size is less than a critical value so as to avoid oversize particles because oversize particles are often defective (e.g. cracked). Such defects can impair the mechanical properties of the product and adversely affect application of metallising layers. The presence of oversize particles can also be undesirable in that the physical properties of the composite product are too heterogeneous, especially in thin sections.

The invention provides in another of its aspects a method of manufacturing a composite material by infiltrating a molten matrix material into a porous pre-form of a reinforcing material, comprising locating the pre-form in a die, covering the pre-form with a mesh held between the pre-form and a perforated lid which fits firmly within the die, positioning solid metal matrix material on top of the perforated lid within the upper part of the die, and heating the die to cause the metal matrix material to melt and pass through the perforated lid to be distributed by the mesh and infiltrate the pre-form.

Preferably the die is placed prior to heating in a pressure vessel which is first evacuated and subsequently pressurised after the metal matrix material has melted.

Specific constructions of apparatus and method embodying the invention will now be described by way of example and with reference to the drawings filed herewith in which.

Figure 1:
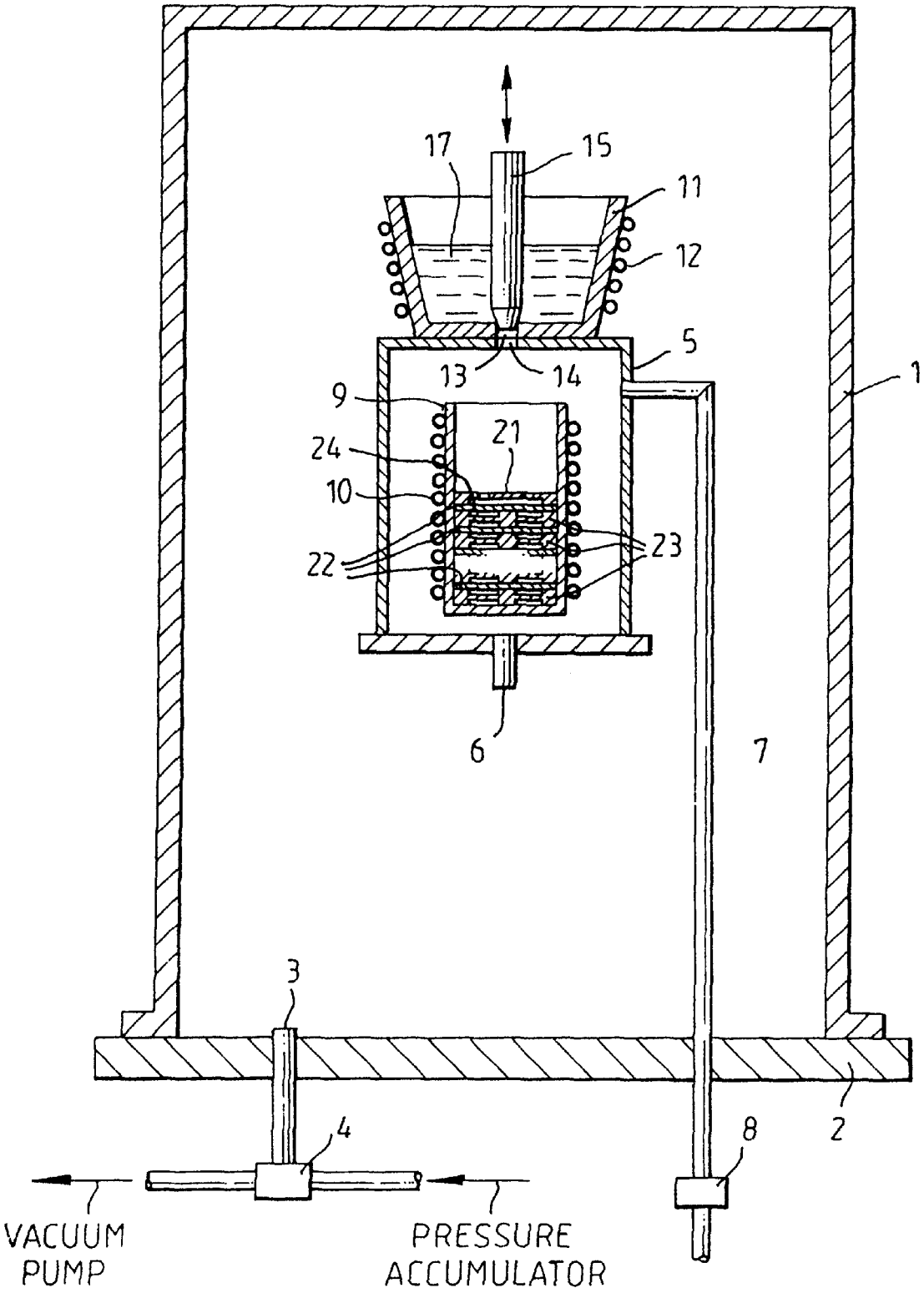
FIG. 1 is a diagrammatic sectional view of an apparatus.

Referring to FIG. 1, an apparatus for the manufacture of metal matrix reinforced composite materials comprises a pressure vessel 1 which has a base plate 2. A port 3 connects the pressure vessel 1 to a vacuum pump (not shown) or a pressure accumulator, which is also not shown, via a two-way valve 4. Mounted within the pressure vessel 1 is a chamber 5. In the base of the chamber 5 is a port 6 which communicates with the interior of the pressure vessel 1. Near the top of the chamber 5 is a vent 7 which passes through the base 2 of the pressure vessel 1 and includes a valve 8. Inside the chamber 5 is a die 9 which is surrounded by a heater 10. Above the die 9 is an open crucible 11 which is also surrounded by a heater 12. A hole 13 in the bottom of the crucible 11 communicates with a similar hole 14 in the top of the chamber 5. The hole 13 in the crucible 11 normally is closed by a plug 15 which can be withdrawn when required by a suitable mechanism (not shown).

In the apparatus shown in FIG. 1, the die 9 comprises a thin walled cylindrical steel vessel with a perforated lid 21 which is an interference fit in the cylindrical interior of die 9 and is positioned on top of an open mesh member. The lid 21 and open mesh member can thus be used to press down upon and densify the contents of the die 9 and also permit permeation therethrough and distribution of molten metal matrix material 17 when this is delivered from the crucible 11. The lid 21 further serves to prevent contents of the die 9 from floating upwards when the molten metal matrix material is introduced into the die 9.

Within the die 9 is a stacked array of separator elements in pairs referenced 22, 23. The array extends continuously from the bottom of the die 9 up to the lid 21, but only three pairs of separator elements are shown in the drawing, for simplicity.

Each separator element 22 is in the form of a thin plate of stainless steel. This co-operates with a double sided shaped separator element 23, also of stainless steel, to define a plurality of disc-shaped cavities 24. It will be appreciated that other shapes can readily be provided by appropriate configuration of the separator element 23.

The cavities 24 are filled with pre-forms of reinforcing material which, in this example, comprises compacted particles of silicon carbide.

The pre-forms are made from a blend of high purity (green) 240 grade and 600 grade silicon carbide. It is important to achieve a particle size distribution about the two mean size values which minimizes the presence of fines and, indeed, as indicated above, minimizes the number of particles having a size less than the Kapitsa radius. Correspondingly, it is important to avoid presence of oversized particles.

A blend involving between 60–70 volume per cent 240 grade particles and correspondingly between 40–30 volume percent 600 grade particles gives a maximum packed volume fraction of silicon carbide which, in practice, can approach 70 per cent. If this maximum is required in the product, I have found that it is practicable to select a blend biased towards the coarser fraction e.g. 70 volume per cent 240 grade with 30 volume per cent 600 grade. This is because the packing fraction is near a maximum value in the first mentioned range above and therefore changing only very slowly with change in particle fraction. By contrast, the permeability of the blend is changing at a fast rate over this range and a substantial increase in permeability can be realised by specifying the packing fraction away from the absolute maximum volume fraction without significant loss in volume fraction.

For manufacturing composites where lower volume fractions are acceptable, a relaxation is possible of the above mentioned requirement to control grain size distribution, in particular to avoid presence of fines. For such applications it may be appropriate to employ unclassified grades of material, as milled.

Some additional densification of pre-forms may be desirable and achieved, for example, by additional pre-pressing using cold isostatic pressing. Some cohesive strength in the pre-forms may be developed by the use of binders (e.g. a colloidal silica binder) or partial pre-sintering. Pre-sintering is useful for increasing volume fraction whilst maintaining permeability. However, we have found that it is important for any such pre-sintering to be carefully controlled to avoid loss of accessible porosity. Ideally the effect of pre-sintering should be that all existing pores between the particles remain and remain accessible but are of reduced dimensions. This ideal can be approached by using carefully controlled microwave heating for the pre-sintering step.

The desired packing density may be achieved by slip casting of silicon carbide mixtures, by freeze casting, or sedimentation from a fluid, alternatively warm moulding of compounds loaded with silicon carbide may be used. The application of vibration (e.g. ultrasonic vibration) may improve packing density. Indeed, ultrasonic vibration may advantageously be applied during infiltration to assist the infiltration process.

When the prepared die 9 and its contents are in position in chamber 5 ready for infiltration with, in the example, molten aluminium matrix material 17 from the crucible 11, the vent valve 8 of vent 7 is closed and the valve 4 is set to connect the pressure vessel 1 to the vacuum pump. When the pressure vessel 1 and the chamber 5 have been evacuated, the port 6 is closed. The heaters 10 and 12 are switched on and both the die, together with the pre-forms 24 and the crucible 11 are raised to a temperature above the melting point of the matrix material 17 in the crucible 11. For aluminium, the die 9 and its contents are preheated to about 700° C. and the aluminium matrix material 17 to about 730° C. The plug 15 is withdrawn so that the molten matrix material 17 passes into the die 9 under the influence of gravity alone. Valve 4 is then reversed to pressurise the pressure vessel 1 and cause the matrix material 17 to infiltrate the pre-forms 24. Finally the valve 8 and port 6 are opened so that gas flows from the inside of the pressure vessel 1 past the die 9 to cool it and solidify the composite material within it. This cooling configuration has the effect that shrinkage of infiltrated pre-forms 24 during solidification is fed by remaining liquid from the supply. This effect is enhanced by providing insulation (not shown) around the side wall of the die 9.

It will be appreciated that the infiltration can be continued isothermally as long as required. A particular advantage for the silicon carbide/aluminium system is that it is a feature of this system that the wetting angle of silicon carbide/liquid aluminium reduces over a time scale of minutes. The smallest pores, which otherwise might not initially be infiltrated under the applied pressures will be subsequently infiltrated on maintaining pressure and temperature over this time scale. In the example described above involving an array of separator elements and pre-forms 24, an infiltration time allowed before cooling of five minutes was found to be adequate.

Figure 2:
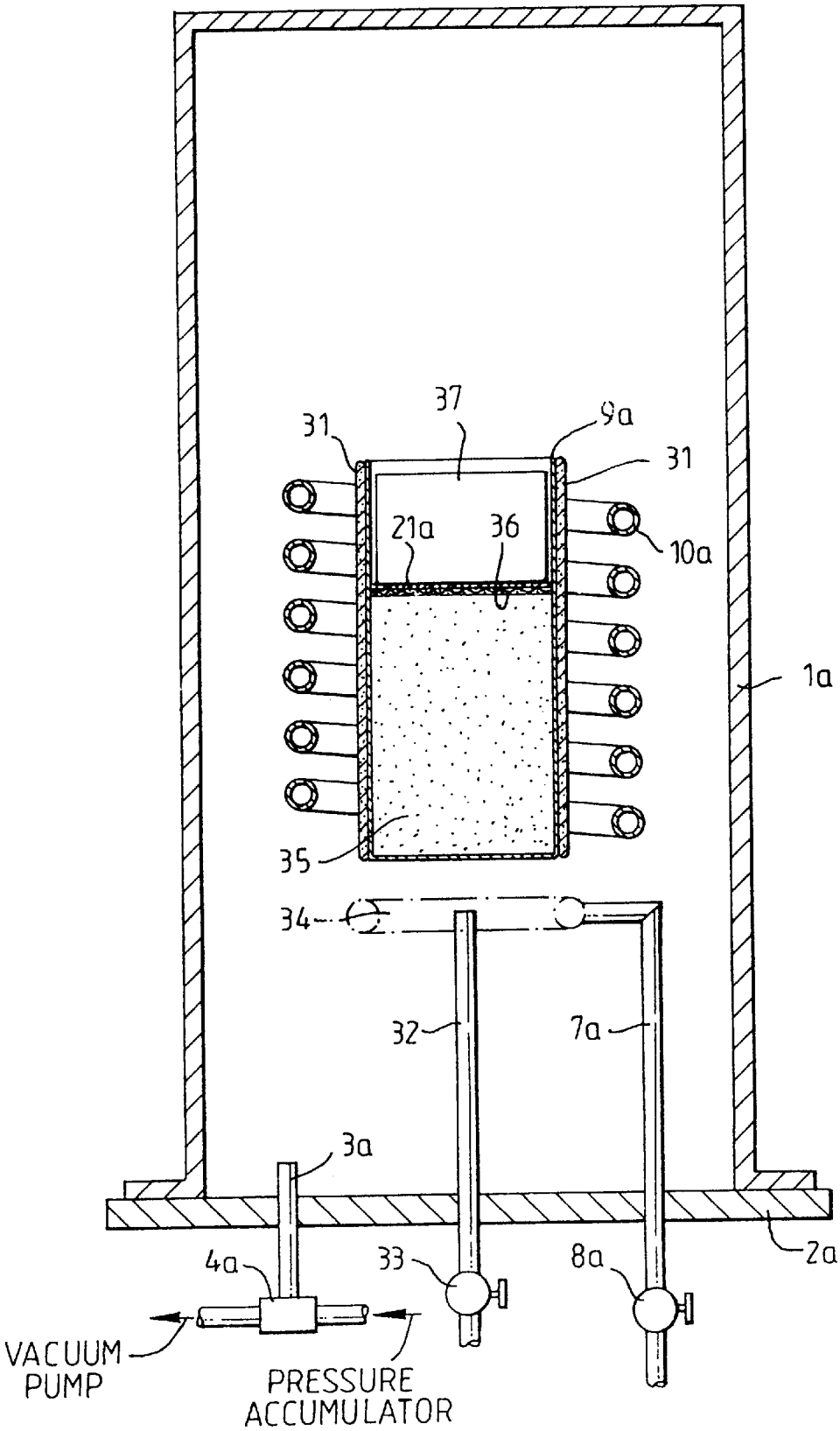
FIG. 2 is a diagrammatic sectional view of a modified apparatus.

FIG. 2 shows a modification of the apparatus of FIG. 1, which modified apparatus provides a number of advantages. Components which perform a similar function to those shown in FIG. 1 are identified by the same reference numeral, distinguished by the suffix "a".

Die 9*a* comprises a thin walled steel vessel having a rectangular box shape. The side walls of the die 9*a* are thermally insulated 31. Radio frequency heating is provided via coils 10*a,* which couples well with the stainless steel of the die 9*a* to provide rapid heat-up.

Port 3*a* and valve 4*a* provide for evacuation and pressurisation as with the apparatus of FIG. 1. A separate pipeline 32 and valve 33 provide for supply of cooling gas. Vent pipe 7*a* controlled by valve 8*a* is fed from a perforated collecting ring pipe 34. The cooling gas pipeline 32 and collecting ring pipe 34 are positioned so as to guide flow of cooling gas over the uninsulated bottom wall of the die 9*a*.

A pre-form 35 of porous reinforcing material is held in position within the die 9*a* by perforated lid 21*a* which is an interference fit in the die 9*a*. An open mesh member 36 is located between the lid 21*a* and the pre-form 35 to distribute molten metal matrix material 37 when this percolates through the perforations in the lid 21*a*. The mesh member also serves to retain silicon carbide powder in place within the die 9*a*. It will be appreciated that the functions of lid 21*a* and mesh member 36 can be combined in a single component, e.g. in the form of a lid alone provided with pores fine enough to serve to retain the silicon carbide powder.

The metal matrix material 37 is positioned initially, as shown, as a solid block in the die 9*a* itself on top of the perforated lid 21*a*. Clearance between the block of matrix material 37 and the walls of the die is necessary to allow for escape of gases from the pre-form during evacuation.

When the prepared die 9*a* and its contents are in position in the pressure vessel 1*a,* the vessel 1*a,* is first evacuated and the heater 10*a* switched on. When the metal matrix material 37 has melted, pressure is applied 20 via valve 4*a*. After infiltration is substantially complete, the heater 10*a* is switched off and cooling gas supplied under pressure via valve 33 and pipeline 32. At the same time the vent 7*a* is opened to atmosphere via valve 8*a*. The resulting controlled flow of cooling gas enables well controlled directional solidification to occur in the die.

It will be appreciated that the configuration of FIG. 2 has advantages over that of FIG. 1 in that the apparatus is simpler, in particular requiring only a single RF heater and avoiding the need for control at high temperature of the flow of molten metal matrix material. The quantity of the latter utilised for each run can be closely controlled and greater control over the temperature, both during heating and cooling can be exercised.

The apparatus of both FIG. 1 and FIG. 2 can be operated in an improved mode which allows for initial heating of the pre-form in the pressure vessel 1, 1*a* with a gas atmosphere chosen to substantially increase the thermal diffusivity of the pre-form material compared with the thermal diffusivity when the gas has been evacuated. In this mode of operation the pressure vessel 1, 1*a* is evacuated as before to remove unwanted residual oxygen or water vapour. Once evacuated, gas may be admitted to the vessel 1, 1*a*. This is selected to be non reactive or oxidising and also to have a sufficiently low moisture content. The gas may be the same as the gas used to pressurise the vessel 1, 1*a* in the later stages of the process, in which case valve 4 is used and connects the vessel 1, 1*a* to the pressure accumulator. Alternatively, other gases may be used.

When the pressure vessel 1, 1*a* has been filled with the gas to the required pressure (usually ambient atmospheric pressure) the heaters are switched on. Once the pre-form core temperature is sufficient, gas is evacuated by connecting the pressure vessel 1, 1*a* to the vacuum pump as before. The remainder of the process is then as previously described.

Figure 3:
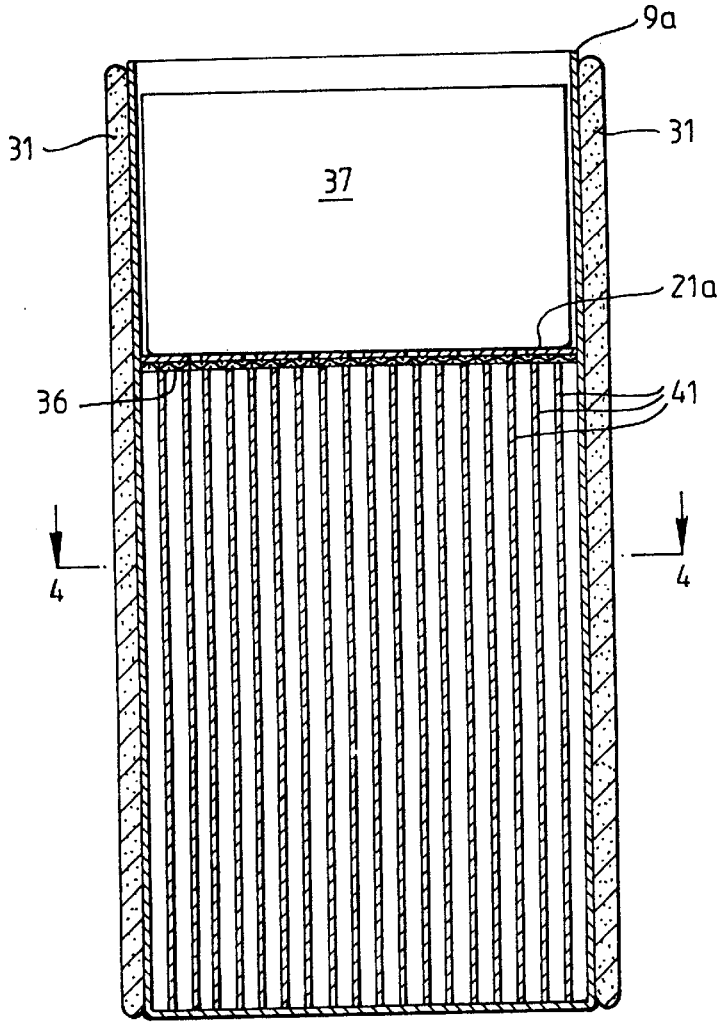
FIG. 3 is an enlarged diagrammatic sectional view of part of the apparatus shown in FIG. 2.
Figure 4:
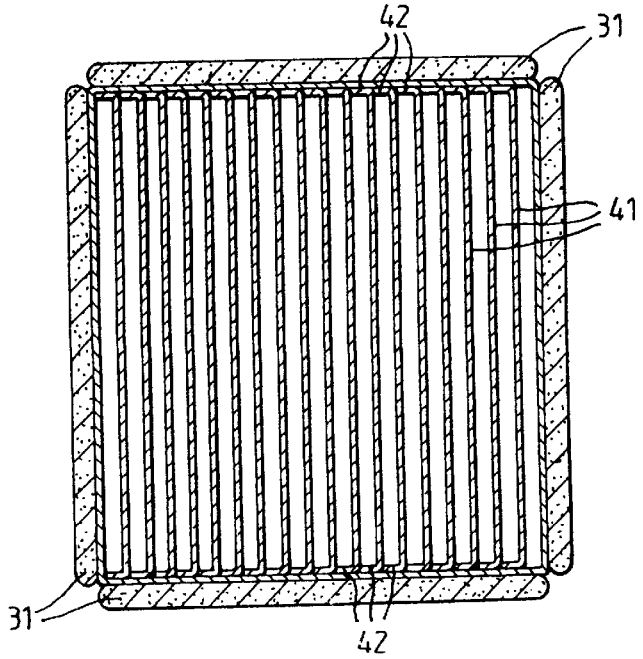
FIG. 4 is a sectional view on the line 4—4 of FIG. 3.

FIGS. 3 and 4 show the die 9*a* in greater detail and, in particular, illustrate a preferred arrangement for forming a plurality of rectangular sheets of product.

Pre-forms of particulate silicon carbide in rectangular sheet form are defined and located by an array of separator plates 41. Two opposite sides of the separator plates 41 are provided with flanges 42 (see FIG. 4) which serve to maintain the desired separation of the plates 41 and to assist in heat transfer from the walls of the die 9*a* into the innermost components forming the core.

The contents of the die 9*a* are held in place by lid 21*a* and the interposed open mesh 36 serves to distribute molten metal matrix material 37 when this percolates into the pre-forms via the perforated lid 21*a*.

The gap between the inner surface of the walls of the die 9*a* and the flanges 42 of the separator plates 41 is arranged to be as small as possible to enhance heat transfer and this will also assist separation of the plates 41 one from another after infiltration and removal of the die 9*a*.

The silicon carbide pre-forms can be introduced into the spaces between the plates 41 by any of the methods described above in relation to FIG. 1. However, the particular configuration shown is readily loaded using pre-prepared sheets of plastics material formed from silicon carbide powders pressed together with binder material. Binder can be removed by heating prior to the infiltration process.

It will be observed that the separator plates 41 in the arrangement of FIGS. 3 and 4 are vertical as distinct from the generally horizontal configuration of FIG. 1. The vertical stacking is advantageous in providing a better orientation for the infiltration of molten metal matrix material, particularly during infilling as directional solidification takes place.

Although graphite or ceramic separator plates 41 are possible they are preferably made of metal, because they are easier to recover and re-use and, in general, can provide better thermal conductivity. Metal separator plates 41 appear effective in providing enhanced infiltration pathways for the molten metal material.

However, use of alloys of carefully chosen thermal expansion co-efficient can be advantageous, in which case the thermal conductivity may not be so good. For example, it is particularly advantageous to tailor the composition of alloy separator plates 41 so that their coefficient of thermal expansion is less than that of the metal matrix composite above the melting point of the metal matrix material, but higher below the melting point of the metal matrix material. The effect will then be for the separator plates 41 to compress the composite during infiltration and shrink away from it after solidification to facilitate subsequent separation.

In another approach, simple flat plates of zirconium are coated with colloidal graphite to which is attached cut shapes from graphite sheet. The cut-away part defines the shape to be replicated in the desired product and is filled (e.g. by doctor-blading) with a slurry of the ceramic reinforcement particles. After drying, a plurality of pre-forms made up in this way are stacked and infiltrated as described above. If desired, holes can be made in the dried slurry. These will fill with metal during the infiltration process, but the metal can be drilled out afterwards much more readily than attempting to drill through ceramic reinforced metal.

If graphite or ceramic separator plates 41 are used, it may be desirable to coat the surface with a release agent which ideally will also serve to inhibit any tendency for the molten metal matrix material to infiltrate into the graphite or ceramic separator plates.

The invention is not restricted to the details of the foregoing examples. For instance the pre-form shape within the die 9 or 9*a* may be supported by an investment material, particularly where complex product shapes are required. It is, of course, important that the investment material is substantially not infiltrated. I have found that fine grit silicon carbide is suitable for this purpose and can conveniently be bound using a salt. A salt binder which is soluble in water will provide for easy removal of the investment material after infiltration and solidification of the product is complete.

In a development, support mounts for dies 9*a* are moveable on a track between a plurality of stations. At one or more of these stations a radio frequency heating coil in a hood can be lowered (and subsequently raised) over the supported die 9*a* to pre-heat the die and its contents. At another station a vacuum chamber and the associated equipment as described with reference to FIG. 2 can be lowered (and subsequently raised) for clamping into vacuum tight engagement with the support mount. With such an arrangement involving for example three stations, it is possible to manage plant operation efficiently. Thus, whilst a loaded die is undergoing infiltration at the central (vacuum chamber) station, loaded dies can be prepared and pre-heated at the outer stations ready for transfer to the central station as soon as the infiltration of the preceding batch has been completed.

I claim:

1. A method of manufacturing a composite material by infiltrating a molten matrix material into porous pre-forms of a reinforcing material, including the operations of locating within a die a plurality of separator elements of shape such as to define a plurality of cavities defining final product dimensions, and filling the cavities with porous reinforcing material comprising particulate material in which the particle size distribution is selected and controlled such that the majority of the particles have a size at or close to one of two different sizes, the relative proportions of particles at the respective two sizes being predetermined, said separator elements being arranged in pairs with one elements of each pair containing cavities filled with said porous reinforcement material and defining the desired shape of all but one side of the product to be formed upon infiltration of the porous reinforcement material with matrix material, and the second element of each said pair comprising a thin plate positioned adjacent the said one element to define the said one side of the product to be formed, placing the die within a pressure vessel together with a quantity of the matrix material, evacuating the pressure vessel, heating both the matrix material and the die to a temperature above the melting point of the matrix material which is positioned so that it is or can be brought into contact with the said porous reinforcement material, pressurising the pressure vessel so as to cause molten matrix material to infiltrate the porous reinforcing material within the die, and cooling the die to cause the matrix material to solidify.

2. A method as claimed in claim 1, wherein the matrix material is initially contained in a crucible also positioned within the pressure vessel, the crucible, the die and the contents of the die are heated together to a temperature above the melting point of the matrix material and the matrix material when molten is transferred from the crucible to the die.

3. A method as claimed in claim 1, wherein the separator elements are in the form of thin plates defining therebetween a plurality of disc-shaped cavities filled with the said porous reinforcing material.

4. A method as claimed in claim 1 wherein separator elements are made from graphite.

5. A method as claimed in claim 1, wherein the size distribution of the particles of the porous reinforcing material is controlled to minimize the number of particles having a size in excess of a predetermined maximum size.

6. A method as claimed in claim 1, wherein the said two particle sizes are respectively 240 grade and 600 grade.

7. A method as claimed in claim 6, wherein the blend of particles of the respective two sizes comprises that which provides the maximum volume fraction of particulate reinforcement in the final infiltrated product.

8. A method as claimed in claim 6, wherein the blend of particles of the two sizes comprises an excess of the larger particle size constituent as compared with that which provides the maximum volume fraction of particulate reinforcement in the final infiltrated product.

9. A method as claimed in claim 6, wherein the blend of particles of the two sizes is chosen so as to provide a predetermined volume fraction of particulate reinforcement in the final infiltrated product for matching a required coefficient of thermal expansion in the product.

10. A method as claimed in claim 1, wherein the separator elements comprise metal which is such as to remain rigid and retain its structure at the temperatures to which the die is subjected for the infiltration.

11. A method as claimed in claim 10, wherein the die comprises a thin walled vessel of a metal which is such as to remain solid and retain its structure at the temperatures to which the die is subjected for the infiltration, but which is easily removed after infiltration and solidification has been completed.

12. A method as claimed in claim 1 including the step of controlling the heating during the said pressurizing of the pressure vessel to sustain substantially isothermal infiltration conditions until infiltration of the said molten matrix material into the porous reinforcing material within the die is complete.

13. A method as claimed in claim 1, wherein the size distribution of the particles of the porous reinforcing material is controlled to minimize the number of particles having a size less than the Kapitsa radius.

14. A method of manufacturing a composite material by infiltrating a molten matrix material into porous preforms of a reinforcing material, including the operations of locating within a die a plurality of separator elements of shape such as to define a plurality of cavities defining final product dimensions, and filling the cavities with porous reinforcing material comprising particulate material in which the particle size distribution is selected and controlled such that the majority of the particles have a size at or close to one of two different sizes, the relative proportions of particles at the respective two sizes being predetermined, placing the die within a pressure vessel together with a quantity of the matrix material, evacuating the pressure vessel, heating both the matrix material and the die to a temperature above the melting point of the matrix material which is positioned so that it is or can be brought into contact with the said porous reinforcement material, pressurising the pressure vessel so as to cause molten matrix material to infiltrate the porous reinforcing material within the die, and cooling the die to cause the matrix material to solidify, wherein the separator elements are in the form of thin plates defining therebetween a plurality of disc-shaped cavities filled with the said porous reinforcing material, wherein the separator elements comprise metal which is such as to remain rigid and retain its structure at the temperatures to which the die is subjected for the infiltration.

15. A method as claimed in claim 14, wherein the die comprises a thin walled vessel of a metal which is such as to remain solid and retain its structure at the temperatures to which the die is subjected for the infiltration and solidification has been completed.

16. A method as claimed in claim 14 wherein the die is heated by radio-frequency heating at a sufficiently low frequency for the separator elements to provide internal heating of the contents of the die.

17. A method of manufacturing a composite material by infiltrating a molten matrix material into porous preforms of a reinforcing material, including the operations of locating within a die a plurality of separator elements of shape such as to define a plurality of cavities defining final product dimensions, and filling the cavities with porous reinforcing material comprising particulate material in which the particle size distribution is selected and controlled such that the majority of the particles have a size at or close to one of two different sizes, the relative proportions of particles at the respective two sizes being predetermined, placing the die within a pressure vessel together with a quantity of the matrix material, evacuating the pressure vessel, heating both the matrix material and the die to a temperature above the melting point of the matrix material which is positioned so that it is or can be brought into contact with the said porous reinforcement material, pressurising the pressure vessel so as to cause molten matrix material to infiltrate the porous reinforcing material within the die, and cooling the die to cause the matrix material to solidify, wherein the separator elements are in the form of thin plates defining therebetween a plurality of disc-shaped cavities filled with the said porous reinforcing material, wherein the die is non-metallic and the contents thereof are heated by microwave heating.

18. A method as claimed in claim 17, wherein the separator elements are made of ceramic which converts microwave radiation into heat.

19. A method of manufacturing a composite material by infiltrating a molten matrix material into porous preforms of a reinforcing material, including the operations of locating within a die a plurality of separator elements of shape such as to define a plurality of separator elements of shape such as to define a plurality of cavities defining final product dimensions, and filling the cavities with porous reinforcing material comprising particulate material in which the particle size distribution is selected and controlled such that the majority of the particles have a size at or close to one of two different sizes, the relative proportions of particles at the respective two sizes being predetermined, placing the die within a pressure vessel together with a quantity of the matrix material, evacuating the pressure vessel, heating both the matrix material and the die to a temperature above the melting point of the matrix material which is positioned so that it is or can be brought into contact with the said porous reinforcement material, pressurising the pressure vessel so as to cause molten matrix material to infiltrate the porous reinforcing material within the die, and cooling the die to cause the matrix material to solidify, wherein the size distribution of the particles of the porous reinforcing material is controlled to minimize the number of particles having a size less than the Kapitsa radius.

20. A method of manufacturing a composite material by infiltrating a molten matrix material into porous preforms of a reinforcing material, including the operations of locating within a die a plurality of separator elements of shape such as to define a plurality of cavities defining final product dimensions, and filling the cavities with porous reinforcing material comprising particulate material in which the particle size distribution is selected and controlled such that the majority of the particles have a size at or close to one of two different sizes, the relative proportions of particles at the respective two sizes being predetermined, placing the die within a pressure vessel together with a quantity of the matrix material, evacuating the pressure vessel, heating both the matrix material and the die, reintroducing gas into the pressure vessel for a period of time during the heating, re-evacuating the pressure vessel prior to the matrix material reaching its melting point, continuing the heating of the matrix material and the die to a temperature above the melting point of the matrix material which is positioned so that it is or can be brought into contact with the said porous reinforcement material, pressurising the pressure vessel so as to cause molten matrix material to infiltrate the porous reinforcing material within the die, and cooling the die to cause the matrix material to solidify.

21. A method of manufacturing a composite material by infiltrating a molten matrix material into porous preforms of a reinforcing material, including the operations of locating within a die a plurality of separator elements of shape such as to define a plurality of cavities defining final product dimensions, and filling the cavities with porous reinforcing material comprising particulate material in which the particle size distribution is selected and controlled such that the majority of the particles have a size at or close to one of two different sizes, the relative proportions of particles at the respective two sizes being predetermined, providing infiltration access to the cavities containing the porous reinforcing material between adjacent separator elements along the length of at least one edge thereof, placing the die within a pressure vessel together with a quantity of the matrix material, evacuating the pressure vessel, heating both the matrix material and the die to a temperature above the melting point of the matrix material which is positioned so that it is or can be brought into contact with the said porous reinforcement material, pressurising the pressure vessel so as to cause molten matrix material to infiltrate the porous reinforcing material within the die, and cooling the die to cause the matrix material to solidify.

22. A method as claimed in claim 21, wherein the matrix material is initially contained in a crucible also positioned within the pressure vessel, the crucible, the die and the contents of the die are heated together to a temperature above the melting point of the matrix material and the matrix material when molten is transferred from the crucible to the die.

23. A method as claimed in claim 21, wherein the separator elements are in the form of thin plates defining therebetween a plurality of disc-shaped cavities filled with the said porous reinforcing material.

24. A method as claimed in claim 21, wherein said infiltration access to the cavities is provided around at least a major proportion of the periphery of the separator elements.

* * * * *